US009068799B1

(12) United States Patent
Wu

(10) Patent No.: US 9,068,799 B1
(45) Date of Patent: Jun. 30, 2015

(54) RETICLE

(71) Applicant: John Wu, Torrance, CA (US)

(72) Inventor: John Wu, Torrance, CA (US)

( * ) Notice: Subject to any disclaimer, the term of this patent is extended or adjusted under 35 U.S.C. 154(b) by 0 days.

(21) Appl. No.: 14/293,648

(22) Filed: Jun. 2, 2014

(51) Int. Cl.
*F41G 1/38* (2006.01)
*F41G 1/473* (2006.01)

(52) U.S. Cl.
CPC . *F41G 1/38* (2013.01); *F41G 1/473* (2013.01)

(58) Field of Classification Search
CPC ..... F41G 1/00; F41G 1/46; F41G 1/38
USPC ..... 33/297, 298
See application file for complete search history.

(56) References Cited

U.S. PATENT DOCUMENTS

| | | | | |
|---|---|---|---|---|
| 4,263,719 | A * | 4/1981 | Murdoch | 33/297 |
| 7,100,320 | B2 * | 9/2006 | Verdugo | 42/130 |
| 7,856,750 | B2 * | 12/2010 | Sammut et al. | 42/122 |
| 7,877,886 | B1 * | 2/2011 | Hamilton | 33/297 |
| 7,937,878 | B2 * | 5/2011 | Sammut et al. | 42/122 |
| 7,946,073 | B1 * | 5/2011 | Buck | 42/130 |
| 7,958,643 | B1 * | 6/2011 | Wu | 33/297 |
| 8,109,029 | B1 * | 2/2012 | Sammut et al. | 42/122 |
| 8,230,635 | B2 * | 7/2012 | Sammut et al. | 42/122 |
| 8,707,608 | B2 * | 4/2014 | Sammut et al. | 42/122 |
| 8,893,971 | B1 * | 11/2014 | Sammut et al. | 235/404 |
| 8,905,307 | B2 * | 12/2014 | Sammut et al. | 235/404 |
| 8,966,806 | B2 * | 3/2015 | Sammut et al. | 42/122 |
| 2003/0046821 | A1 * | 3/2003 | Horie et al. | 33/297 |
| 2007/0044364 | A1 * | 3/2007 | Sammut et al. | 42/122 |
| 2008/0098640 | A1 * | 5/2008 | Sammut et al. | 42/122 |
| 2008/0202011 | A1 * | 8/2008 | Shepherd | 42/130 |
| 2009/0235570 | A1 * | 9/2009 | Sammut et al. | 42/122 |
| 2011/0107649 | A1 * | 5/2011 | Buck | 42/130 |
| 2011/0132983 | A1 * | 6/2011 | Sammut et al. | 235/404 |
| 2012/0030988 | A1 * | 2/2012 | Windauer | 42/119 |
| 2013/0014421 | A1 * | 1/2013 | Sammut et al. | 42/122 |
| 2014/0109459 | A1 * | 4/2014 | Sammut et al. | 42/122 |

* cited by examiner

*Primary Examiner* — Yaritza Guadalupe-McCall
(74) *Attorney, Agent, or Firm* — Clement Cheng

(57) ABSTRACT

A reticle has a horizontal section having a horizontal section horizontal line. The horizontal section has horizontal section vertical lines. A vertical section has a vertical section vertical line, wherein the horizontal section intersects the vertical section at a midpoint. The vertical section has vertical section horizontal lines. A first ranging system includes a metric units ranging scale. The metric units ranging scale includes a first metric units framing bracket and a second metric units framing bracket. The first metric units framing bracket is larger than the second metric units framing bracket. The metric units ranging scale further includes a metric units vertical ruler and a metric units horizontal ruler.

14 Claims, 4 Drawing Sheets

RETICLE

FIELD OF THE INVENTION

The present invention is in the field of optical reticles.

DISCUSSION OF RELATED ART

A variety of different reticle patents are known in the art including mil-dot style patterns such as described in U.S. Pat. No. 7,701,975 issued to Farris Apr. 27, 2010 the disclosure of which is incorporated herein by reference. A wide variety of other different reticle styles have been described in the literature and some are the subject of United States patents. The present invention has an object to provide yet another useful reticle design.

Inventor John Wu in U.S. Pat. No. 7,958,643 issued Jun. 14, 2011 entitled Reticle, the disclosure of which is incorporated herein by reference, describes a reticle that comprises a horizontal section having horizontal section horizontal lines broken by horizontal section gaps between the horizontal section horizontal lines. A vertical section has vertical section vertical lines broken by vertical section gaps between the vertical section vertical lines. The horizontal section intersects the vertical section at a midpoint. A wide measurement ranging system includes range indicators including a highest range indicator, a plurality of intermediate range indicators, and a lowest range indicator. A height measurement ranging system has range indicators which include height measurement horizontal lines and which include a height measurement lowest range indicator closest to the vertical section, height measurement intermediate range indicators, and a height measurement highest range indicator.

Generally speaking, a reticle may have a variety of different mil skills. A circle has 360 degrees or 6283 mils. One mil appears as about 3.6" at 100 yards, 7.2" at 200 yards, 14.4" at 400 yards. Determining bullet drop can be complicated in the field due to the mathematics involved.

SUMMARY OF THE INVENTION

A reticle has a horizontal section having a horizontal section horizontal line. The horizontal section has horizontal section vertical lines. A vertical section has a vertical section vertical line, wherein the horizontal section intersects the vertical section at a midpoint. The vertical section has vertical section horizontal lines. A first ranging system includes a metric units ranging scale. The metric units ranging scale includes a first metric units framing bracket and a second metric units framing bracket. The first metric units framing bracket is larger than the second metric units framing bracket. The metric units ranging scale further includes a metric units vertical ruler and a metric units horizontal ruler.

A second ranging system includes an English units ranging scale. The English units ranging scale includes a first English units framing bracket and a second English units framing bracket. The first English units framing bracket is larger than the second English units framing bracket. The English units ranging scale further includes an English units vertical ruler and in English units horizontal ruler.

A third metric units framing bracket is located on the metric units ranging scale, and a third English units framing bracket is located on the English units ranging scale. A fourth metric units framing bracket is located on the metric units ranging scale, and a fourth English units framing bracket is located on the English units ranging scale. The first metric units framing bracket and the first English units framing bracket are set to a predetermined height and predetermined width and include a horizontal framing bracket line of the predetermined width that is oriented perpendicular to a vertical framing bracket line of the predetermined height.

The reticle optionally includes a dot at the midpoint. The reticle may also have a ring bounding the reticle. The reticle vertical section further includes a lower vertical section, and the lower vertical section has bullet drop compensation markings. The bullet drop compensation markings include both a vertical minute of angle ruler and a vertical miliradian ruler. Preferably, a dial has magnification indicia and range indicia marked on the dial. The dial is mounted to the scope, so that the dial is configured to control magnification when the user turns the dial. Turning the dial also necessarily produces a range indicia reading.

Figure 1:
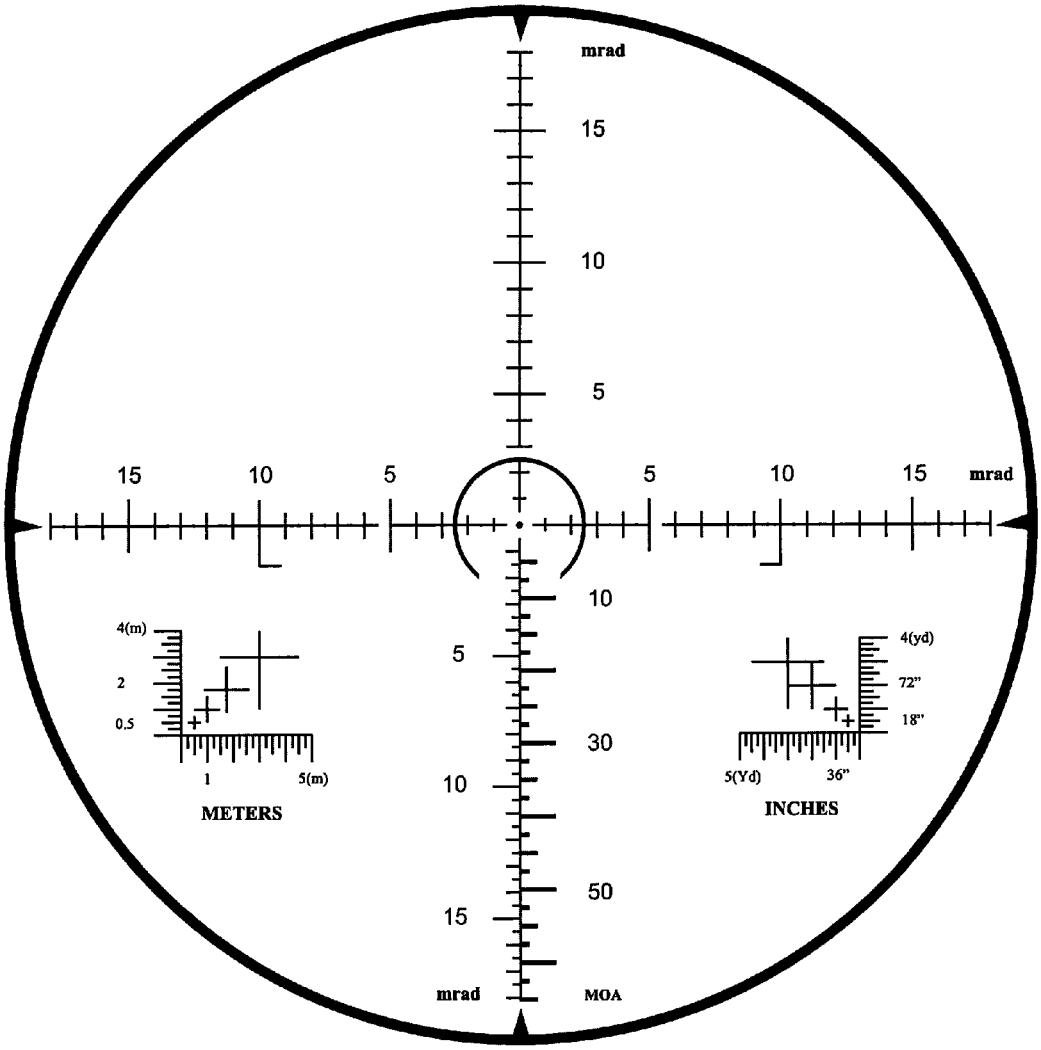
FIG. 1 is a front view of the best mode of the present invention without callouts.
Figure 2:
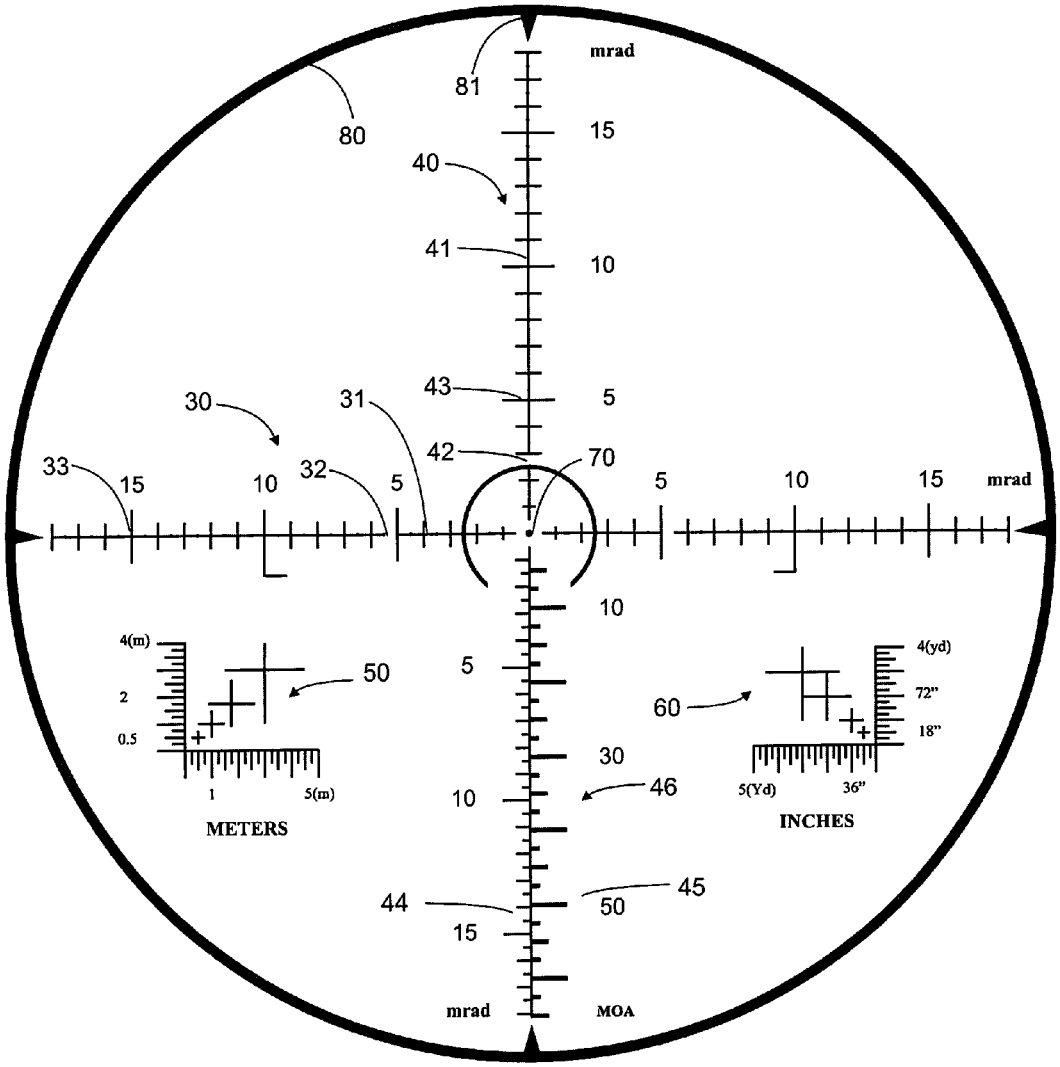
FIG. 2 is a front view of the present invention with callouts.
Figure 3:
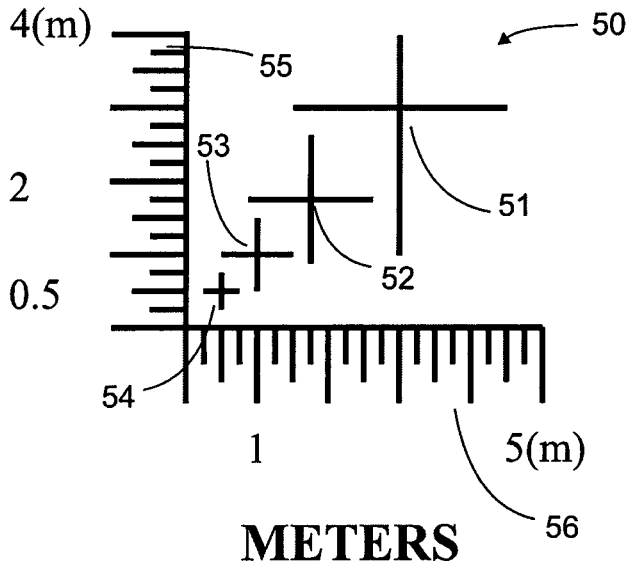
FIG. 3 is a front view of the meters ranging scale.
Figure 4:
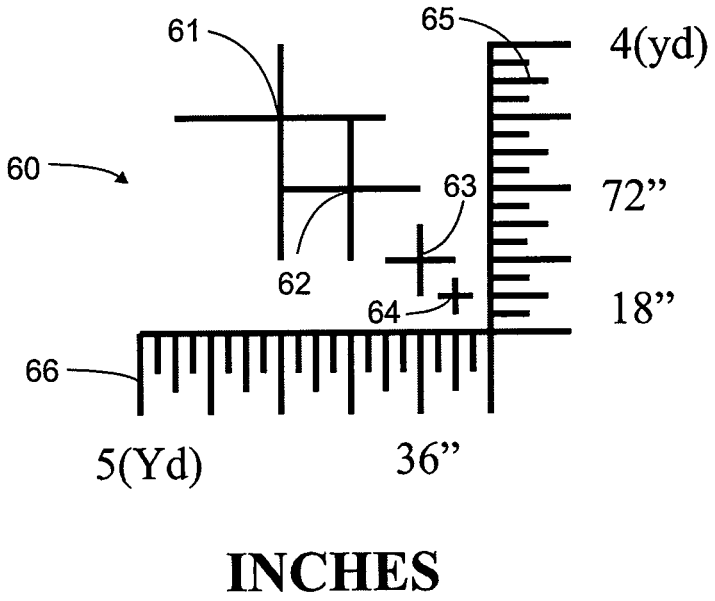
FIG. 4 is a front view of the inches ranging scale.
Figure 5:
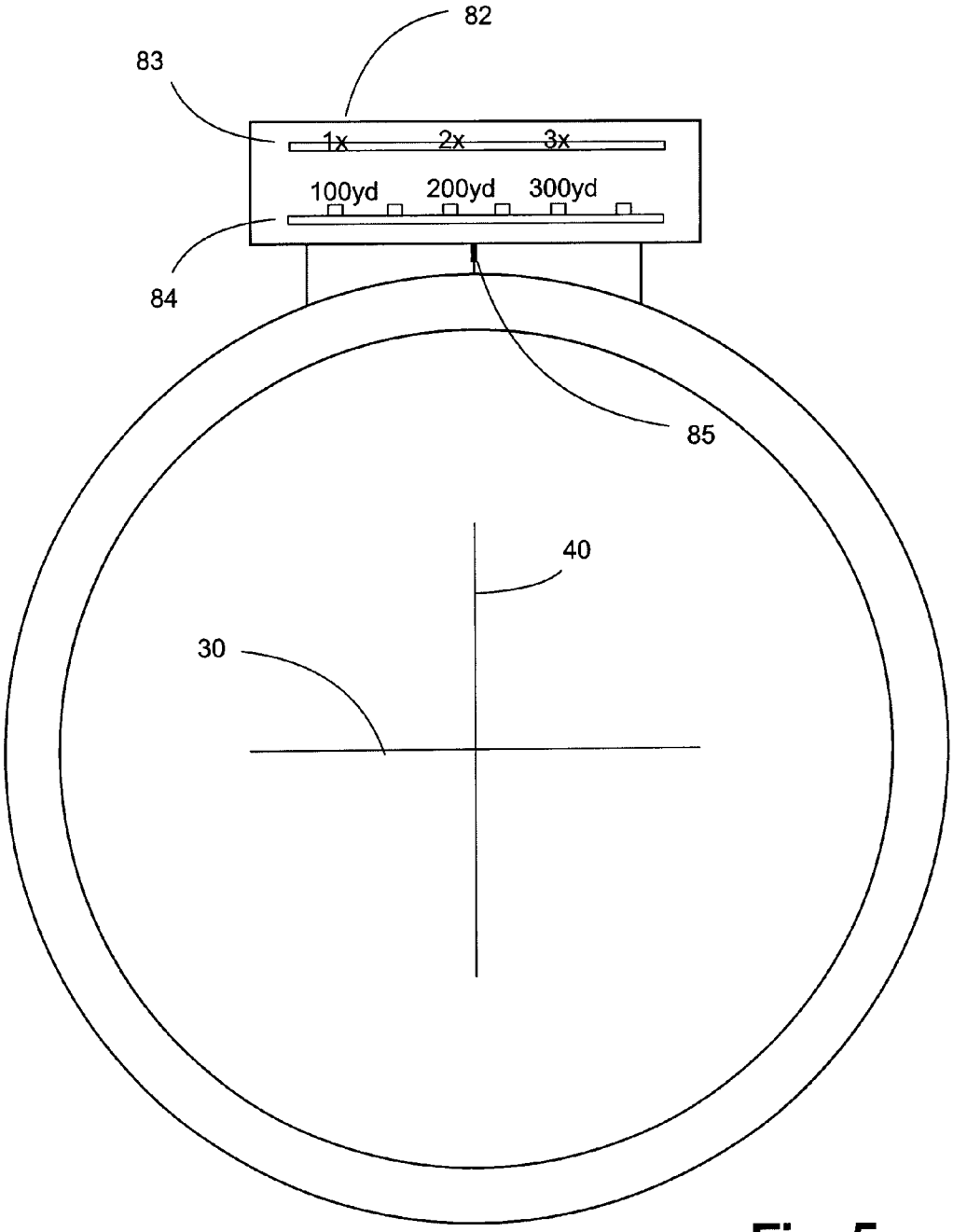
FIG. 5 is a front view of the scope having the reticle.

The following call out list of elements may be a useful guide in referencing the elements of the drawings.

30 Horizontal Section
31 Horizontal Section Horizontal Line
32 Horizontal Section Gap
33 Horizontal Section Vertical Line
40 Vertical Section
41 Vertical Section Vertical Line
42 Vertical Section Gap
43 Vertical Section Horizontal Line
44 Vertical Miliradian Ruler
45 Vertical Minute Of Angle Ruler
46 Lower Vertical Section
50 Metric Units Ranging Scale
51 First Metric Units Framing Bracket
52 Second Metric Units Framing Bracket
53 Third Metric Units Framing Bracket
54 Fourth Metric Units Framing Bracket
55 Metric Units Vertical Ruler
56 Metric Units Horizontal Ruler
60 English Units Ranging Scale
61 First English Units Framing Bracket
62 Second English Units Framing Bracket
63 Third English Units Framing Bracket
64 Fourth English Units Framing Bracket
65 English Units Vertical Ruler
66 English Units Horizontal Ruler
70 Midpoint
80 Ring
81 Ring Markers
82 Dial
83 Magnification Indicia
84 Range Indicia
85 Reading Mark

DETAILED DESCRIPTION OF THE PREFERRED EMBODIMENT

The present invention is a second focal plane rifle scope where the image changes magnification while the reticle stays constant. A dial 82 on the scope allows a user to change the magnification by turning the dial 82 in a clockwise or counterclockwise rotation. The dial 82 has magnification indicia 83 that indicates magnification, and range indicia 84 that indicates range. The indicia on the dial 82 are fixed and can be engraved on the aluminum surface of the dial along a circumferential periphery of the dial. The indicia can be read at a reading mark 85 that is formed as an elongated rectangle, arrow or triangle engraved on an aluminum surface of the rifle scope. As a user turns the dial 82, the indicia marked on the dial will turn so that a different portion of the indicia aligns with the reading mark 85 to provide a different magnification indication and to provide a different range indication. The range is preferably linearly proportional to the magnification so that both of them can be fixed relative to each other. The indicia can be marks or symbols such as numbers and letters. The best mode would be to have the range expressed as numbers.

A user generally picks up the scope and looks through the ring 80. A variety of different ring markers 81 can be placed at a top, bottom, left, and right position of the ring 80. The ring markers 81 can provide quick reference for initial orientation. After initial orientation, the user finds the target object in the scope and then turns the power ring 80 to control the magnification to zoom in to the target until the known size of the object approximates the scale of the quick framing brackets in the vertical or horizontal ruler dimensions. The object is then quick framed using one of the framing brackets to determine the range.

The reticle has two sets of framing brackets that are located within a metric units ranging scale 50 and an English units ranging scale 60. The metric units ranging scale has a set of metric units framing brackets. The first set of framing brackets is on the left and has metric measurements. The largest framing bracket is set at 3 m long along a horizontal framing bracket line and set at 3 m high along a vertical framing bracket line. The second largest framing bracket is set at 1.75 m along a horizontal framing bracket line and set at 1.75 m high along a vertical framing bracket line. The third largest framing bracket is set at 1 m along a horizontal framing bracket line, and set at 1 m high along a vertical framing bracket line. The smallest framing bracket is set at 0.5 m along a horizontal framing bracket line and set at 0.5 m high along a vertical framing bracket line. The user matches any object of known size to match one of the framing brackets with the object size.

The first metric units framing bracket 51 is the largest framing bracket. The second metric units framing bracket 52 is the second largest framing bracket. The third metric units framing bracket 53 is the third largest framing bracket. The fourth metric units framing bracket 54 is the fourth largest framing bracket. After using the metric framing brackets to approximate the size of the target, the user can then use the horizontal or vertical ruler to fine tune the magnification zoom of the scope. The user can use the metric units vertical ruler 55 for trying to match a target of a certain height. The user can use the metric units horizontal ruler 56 for trying to match a target of a certain width.

The English units ranging scale 60 has a second set of framing brackets. The second set of framing brackets is in English units with the largest framing bracket having a horizontal framing bracket line set at 5 yards with a vertical framing bracket line set at 4 yards. The second largest framing bracket has a horizontal framing bracket line and a vertical framing bracket line set at 72". The third largest framing bracket has a horizontal framing bracket line and a vertical framing bracket line set at 36". The smallest framing bracket has a horizontal framing bracket line and a vertical framing bracket line set at 18". The largest framing bracket is the first English units framing bracket 61. The second largest framing bracket is the second English units framing bracket 62. The third largest framing bracket is the third English units framing bracket 63. The fourth largest framing bracket is the fourth English units and bracket 64. After using the English framing brackets to approximate the size of the target, the user can then use the horizontal or vertical ruler to fine tune the magnification zoom of the scope. The user can use the English units vertical ruler 65 for trying to match a target of a certain height. The user can use the English units horizontal ruler 66 for trying to match a target of a certain width. Meters refers to the metric system based on the international system of measurement, and inches refers to English units which are imperial and United States customary systems of measurement.

The ranging scales are used for ranging of the target without mathematical calculations using the principle of known size of the target. The sets of framing brackets can be used alternatively, with a user estimating using both the English units and metric units to check the known size of the target. The horizontal and vertical ruler are used to fine tune the distance after using the quick framing brackets.

After a user matches a target size with the framing bracket, the user can check the target size against the vertical and horizontal ruler to fine tune the magnification dial setting. Once the magnification dial setting is finalized, the magnification setting corresponds with a range. The user reads the range at the reading mark. So as not to confuse the magnification indicia with the range indicia, the magnification indicia can be anodized with the same color as the scope and with the range indicia in contrasting color.

The user may find the target in the midpoint 70 at close ranges, but longer ranges bullet drop compensation will need to be determined. Once the range is determined, the user can look up bullet drop based upon a chart, or based upon previous knowledge and experience. The user uses the range to obtain an MOA or mrad bullet drop value. The bullet drop is calculated using mathematics or a chart and expressed in terms of mrad or MOA. The bullet drop can then be compensated by aligning the diagonal line of the lower vertical line to the target, colloquially termed Arkansas elevation.

The center dot can be calibrated to zero at 100 m or more. The midpoint 70 can be marked by a center dot. The user can look at the horizontal section 30 and the vertical section 40. The horizontal section 30 is perpendicular to the vertical section 40. The horizontal section has a horizontal section horizontal line 31 that is marked by a plurality of horizontal section vertical lines 33 and optionally a horizontal section gap 32 that is formed as a gap on the horizontal section horizontal line 31. The vertical section 40 as a vertical section vertical line 41 that is marked by a plurality of vertical section horizontal lines 43. The vertical section may also have a vertical section gap 42 that is formed as a gap on the vertical section vertical line 41. The vertical section 40 has a lower vertical section 46 on a lower half of the vertical section 40. The lower vertical section 46 has a vertical miliradian ruler 44 and a vertical minute of angle ruler 45. The lower vertical section 46 is used by correlating the known bullet drop from a chart or computer to the location on the lower vertical section 46. For example, if a user determines that the range is 300 yards, the user may know the bullet drop to be a certain mrad (miliradian) or a certain MOA (minute of angle) at that range. The user can then align the target with the vertical section vertical line 41 and the vertical section horizontal line 43 corresponding with the known bullet drop at the distance previously calculated.

The dial 82 has range and magnification, and can be illuminated such as by glow-in-the-dark indicia. The reading mark 85 preferably faces the user with the dial 82 at least partially visible by the user.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims. For example, the reticle may be made in a variety of different colors. Persons skilled in this art will readily appreciate that various additional changes and modifications may be made without departing from the spirit of the invention, as defined and differentiated by the following claims.

The invention claimed is:

1. A reticle comprising:

a. a horizontal section having a horizontal section horizontal line, wherein the horizontal section has horizontal section vertical lines;

b. a vertical section having a vertical section vertical line, wherein the horizontal section intersects the vertical section at a midpoint, wherein the vertical section has vertical section horizontal lines;

c. a first ranging system including a metric units ranging scale, wherein the metric units ranging scale includes a first metric units framing bracket and a second metric units framing bracket, wherein the first metric units framing bracket is larger than the second metric units framing bracket, wherein the metric units ranging scale further includes a metric units vertical ruler and a metric units horizontal ruler; and d. a second ranging system including an English units ranging scale, wherein the English units ranging scale includes a first English units framing bracket and a second English units framing bracket, wherein the first English units framing bracket is larger than the second English units framing bracket, wherein the English units ranging scale further includes an English units vertical ruler and in English units horizontal ruler.

2. The reticle of claim 1, further comprising a third metric units framing bracket located on the metric units ranging scale, and a third English units framing bracket located on the English units ranging scale.

3. The reticle of claim 1, further comprising a fourth metric units framing bracket located on the metric units ranging scale, and a fourth English units framing bracket located on the English units ranging scale.

4. The reticle of claim 1, wherein the first metric units framing bracket and the first English units framing bracket are set to a predetermined height and predetermined width and include a horizontal framing bracket line of the predetermined width that is oriented perpendicular to a vertical framing bracket line of the predetermined height.

5. The reticle of claim 1, further comprising a dot at the midpoint.

6. The reticle of claim 1, further comprising a ring bounding the reticle.

7. The reticle of claim 1, wherein the vertical section further includes a lower vertical section, wherein the lower vertical section has bullet drop compensation markings, wherein the bullet drop compensation markings include both a vertical minute of angle ruler and a vertical miliradian ruler.

8. The reticle of claim 1, further comprising a dial having magnification indicia and range indicia marked on the dial, wherein the dial is located on the scope, wherein the dial is configured so that turning the dial controls magnification.

9. The reticle of claim 8, further comprising a third metric units framing bracket located on the metric units ranging scale, and a third English units framing bracket located on the English units ranging scale.

10. The reticle of claim 8, further comprising a fourth metric units framing bracket located on the metric units ranging scale, and a fourth English units framing bracket located on the English units ranging scale.

11. The reticle of claim 8, wherein the first metric units framing bracket and the first English units framing bracket are set to a predetermined height and predetermined width and include a horizontal framing bracket line of the predetermined width that is oriented perpendicular to a vertical framing bracket line of the predetermined height.

12. The reticle of claim 8, further comprising a dot at the midpoint.

13. The reticle of claim 8, further comprising a ring bounding the reticle.

14. The reticle of claim 8, wherein the vertical section further includes a lower vertical section, wherein the lower vertical section has bullet drop compensation markings, wherein the bullet drop compensation markings include both a vertical minute of angle ruler and a vertical miliradian ruler.

* * * * *